United States Patent [19]

Schutz et al.

[11] Patent Number: 4,879,150

[45] Date of Patent: Nov. 7, 1989

[54] JUMBO ROLL OF TOILET TISSUE

[75] Inventors: Rudolph W. Schutz, Walnut Creek; William Schultz, Piedmont, both of Calif.

[73] Assignee: James River II, Inc., Oakland, Calif.

[21] Appl. No.: 258,759

[22] Filed: Oct. 17, 1988

Related U.S. Application Data

[60] Continuation-in-part of Ser. No. 20,635, Mar. 2, 1987, abandoned, which is a division of Ser. No. 121,310, Nov. 16, 1987, Pat. No. 4,796,832.

[51] Int. Cl.[4] ..... B32B 3/02

[52] U.S. Cl. ..... 428/43; 428/906; 242/1

[58] Field of Search ..... 428/43, 906; 242/1

[56] References Cited

U.S. PATENT DOCUMENTS 421,497 2/1890 Hicks ..... 428/43

4,796,832 1/1989 Schutz ..... 242/55.3

*Primary Examiner*—Alexander S. Thomas

*Attorney, Agent, or Firm*—Stanley M. Teigland

[57] ABSTRACT

A jumbo roll of toilet tissue wherein the initial section of the roll is perforated and the remainder is unperforated is dispensed from a dispenser having, in addition to a first spindle for supporting the jumbo roll, a second spindle for receiving the preceding roll of tissue after most of the tissue has been consumed. The spindles are secured by means that discourage pilferage of the rolls but permit access to them by an attendant when the rolls are changed. The second spindle is readily detachable and can be mounted on either side of the dispenser.

1 Claim, 4 Drawing Sheets

44
C
A
46
48
47
8
8
13"
13"
44

JUMBO ROLL OF TOILET TISSUE

This is a continuation-in-part of application Ser. No. 20,635, filed Mar. 2, 1987, now abandoned, and a division of application Ser. No. 121,310, filed Nov. 16, 1987, now U.S. Pat. No. 4,796,832.

BACKGROUND OF THE INVENTION

Rolls of toilet tissue that are several times larger than normal size rolls are being sold for institutional use in special dispensers. Such rolls, which typically have a diameter between about 20 and 30 centimeters, are referred to as jumbo rolls. The disposition of the rolls when part of the tissue has been consumed is currently a problem. Discarding the partially spent roll, which is called a stub or remnant roll, is wasteful while leaving the roll in the dispenser incurs the risk that the tissue will be depleted without another source of tissue being available. This invention provides a convenient solution to the problem.

SUMMARY OF THE INVENTION

This invention provides a dispenser having, in addition to a first spindle for receiving the jumbo roll, a second spindle for receiving the stub roll. The rolls are secured by means that discourage pilferage of the rolls but permit access to them by an attendant when the rolls are changed. This invention also provides a special roll of tissue for use in such a dispenser. Unlike a conventional jumbo roll of tissue, which is either all perforated or all unperforated, the initial section (i.e., the section closest to the core) of the roll of this invention has transverse lines of perforations for a predetermined length of the roll corresponding to the length of the initial section. The remaining (terminal) section is unperforated.

DETAILED DESCRIPTION

Figure 1:
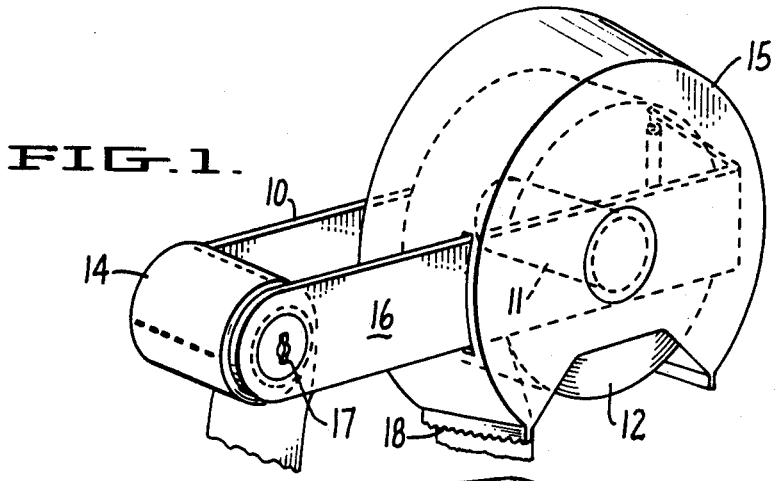
FIG. 1 is a perspective view of an embodiment of the dispenser of this invention shown in the closed (locked) position.
Figure 2:
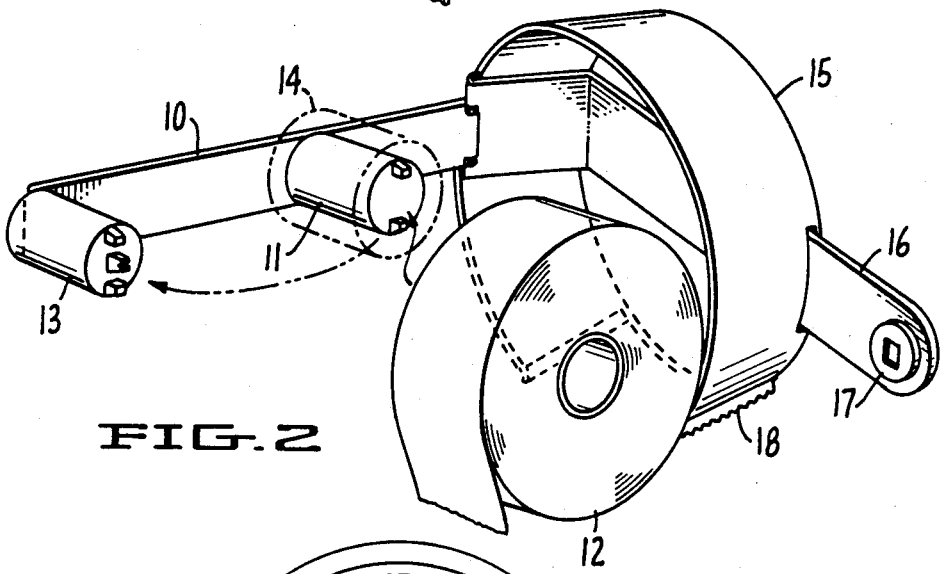
FIG. 2 is a perspective view of the dispenser of FIG. 1 shown in the open position.

Referring to FIGS. 1 and 2, the dispenser comprises a base 10 adapted to be secured to a wall. A first spindle 11 extends from the base 10 for supporting a jumbo roll of tissue 12. A second spindle 13 is mounted on the base 10 for supporting a stub roll 14. A housing 15, which is adapted to enclose the first spindle 11 and the jumbo roll 12, but not the second spindle 13 or the stub roll 14, is hinged by means of a bar 16 to the base 10. The bar 16, which supports the housing 15 and extends from it, is adapted to engage the free end of the second spindle 13. A locking mechanism 17 mounted on the bar 16, or other lock means, is employed to secure the bar 16 to the second spindle 13. When the mechanism 17 is locked, as shown in FIG. 1, the jumbo roll 12 and the stub roll 14 cannot readily be removed. When the mechanism 17 is unlocked, the bar 16 and the housing 15 can be swung open, as shown in FIG. 2, to permit access to the first and second spindles for replacing the rolls.

The housing 15 has a serrated edge 18, as is conventional, to facilitate tearing of the roll supported by the first spindle. A serrated edge is not necessary to facilitate tearing of the roll supported by the second spindle because, in accordance with this invention, the initial section of the jumbo roll of tissue has transverse lines of perforations, as shown in FIG. 1. The length of the perforated section is about equal to the length of a normal size roll of tissue, i.e., a length corresponding to a roll diameter between about 10 and 15 centimeters, or between about 40 to 60 percent of the diameter of the jumbo roll.

Initially, with the locking mechanism 17 unlocked, a restroom attendant swings open the housing 15, places a jumbo roll of toilet tissue on first spindle 11, and closes the housing 15, which locks the locking mechanism 17. After a period of time, depending on the frequency of use, the attendant checks the amount of toilet tissue remaining on the roll in the housing. If the roll is down to the perforated section, the attendant unlocks the locking mechanism 17 such as with a key (not shown), transfers the stub roll from the first spindle 11 to the second spindle 13, places a new jumbo roll of tissue on the first spindle 11, and closes the housing 15, which locks the locking mechanism 17. The steps of transferring the stub roll 14 to the second spindle 13 and placing the jumbo roll 12 on the first spindle 11 are indicated by arrows in FIG. 2. The situation resulting after completion of the steps and closing of the housing 15 is shown in FIG. 1.

Figure 3:
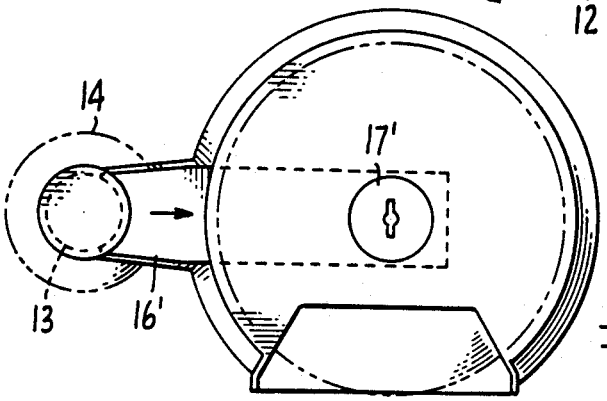
FIG. 3 is a front view of another embodiment of the dispenser of this invention.

In the embodiment shown in FIG. 3, a bar 16' is slidably mounted on the housing 15 and engages the free end of the second spindle 13 by sliding into a groove at the end of the spindle. Sliding movement of the bar 16' is controlled by a locking mechanism 17', which is mounted at the center of the housing 15. When the mechanism 17' in unlocked, such as by inserting a key and turning it clockwise, the bar 16' slides in the direction shown by the arrow, thereby permitting the housing 15 to be swung open to enable the attendant to access the rolls.

Figure 4:
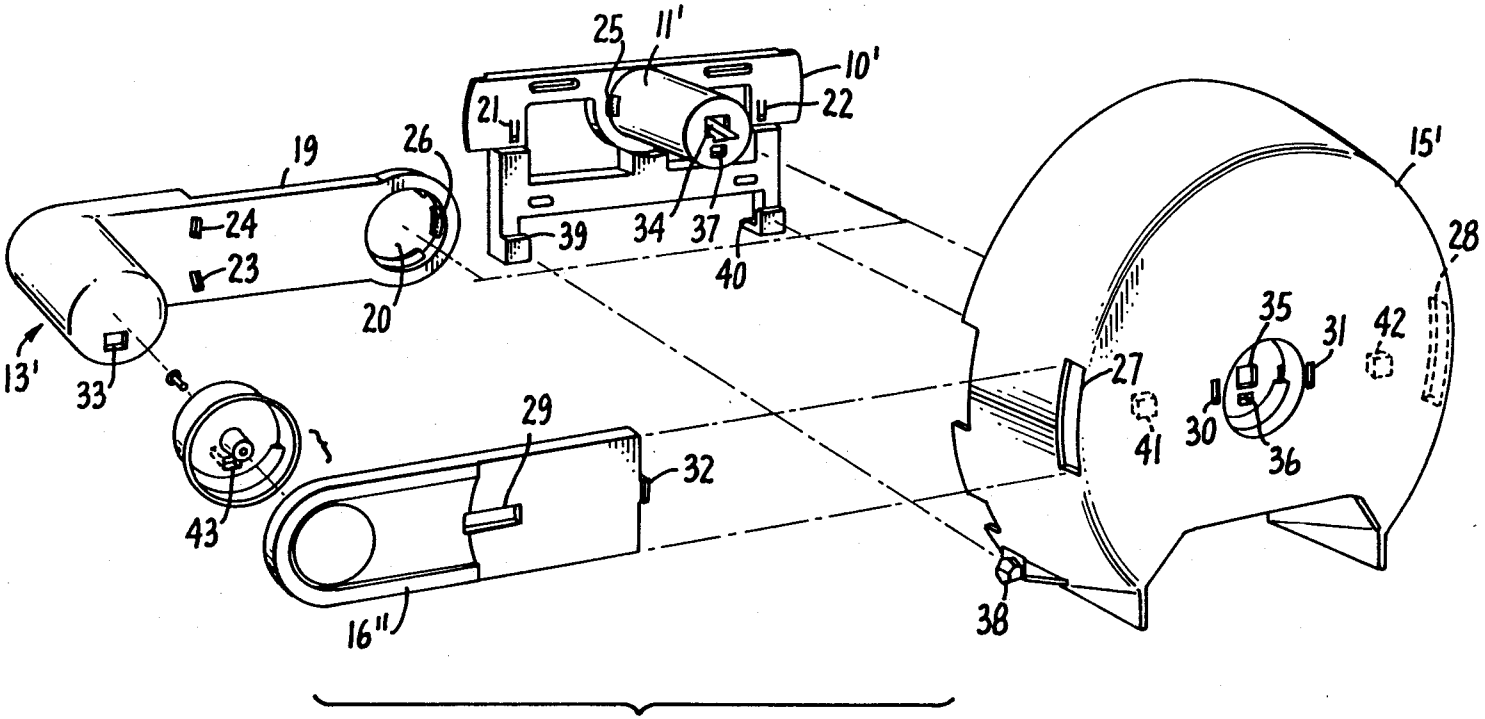
FIG. 4 is an exploded perspective view of still another embodiment of the dispenser of this invention.

In the embodiment shown in FIG. 4, the bar 16'' and a tongue 19 supporting the second spindle 13' are readily detachable from the housing 15' and the base 10', respectively, and are adapted to engage the housing 15' and base 10' so that they can be mounted on either the left hand or the right hand side of the dispenser. The tongue 19 terminates in an aperture 20 that is adapted to slip over the first spindle 11'. Means are provided for detachably securing the tongue 19 to the base 10'. These means may be a pair of detents 21 and 22 on the base 10' that are adapted to engage slots 23 and 24, respectively, in the tongue 19, and one or more detents 25 on the first spindle 11' that are adapted to engage an arcuate tab 26 extending from the tongue 19 toward the center of the aperture 20. The housing 15' has a slot 27, 28 on each side for receiving the bar 16''. Means are provided for detachably securing the bar 16'' to the housing 15' such as detents 41, 42 on the inner surface of the housing 15' that are adapted to engage a slot 29 in the bar 16'', and a slot 30, 31 on each side of the housing to engage a tab 32 extending from the bar 16''. To support the bar 16'', the second spindle 13' has a recess 33 for receiving a male fitting 43 extending from the bar 16''. Extending from the first spindle 11' is a first latch 34 adapted to engage the housing 15' through hole 35 and thereby lock the dispenser. The dispenser may be unlocked by inserting a key (not shown) into keyholes 36, 37 in the housing 15' and first spindle 11', respectively. Extending from each side of the housing 15' is a journal pin 38 that is supported by bearings 39, 40 formed in the base 10'. When the dispenser is unlocked, the housing 15' can be tilted down to permit access to the first and second spindles. A particular advantage of the embodiment shown in FIG. 4 is that the elements supporting the stub roll can readily be switched from one side of the dispenser to the other. Also, if desired, the elements can readily be removed to provide a dispenser supporting only the jumbo roll.

Figures 5, 6, 7:
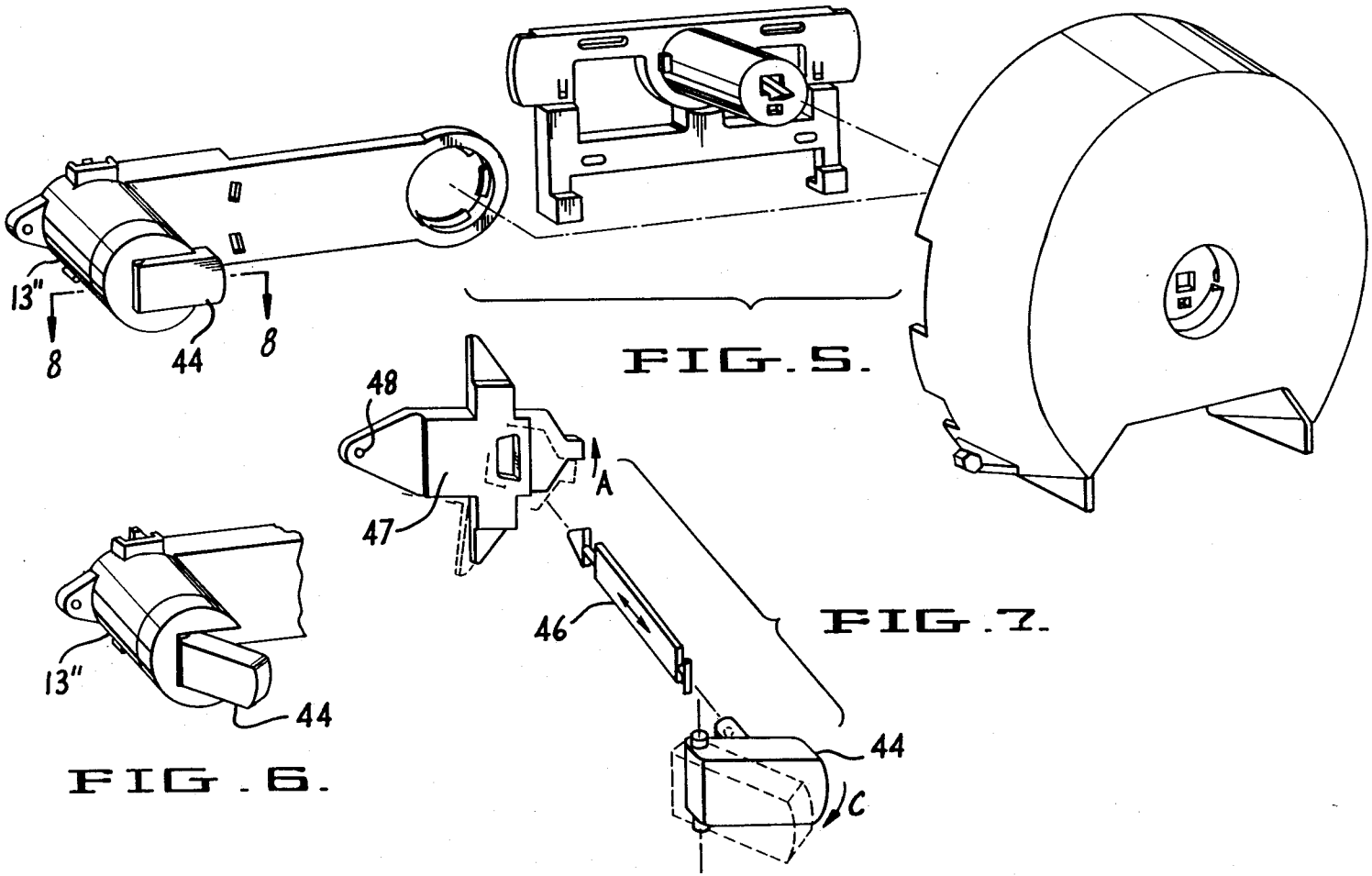
FIG. 5 is an exploded perspective view of the preferred embodiment of the dispenser of this invention.
FIG. 6 is a perspective view of the second spindle of the dispenser shown in FIG. 5.
FIG. 7 is an exploded perspective view of means for discouraging pilferage of a stub roll borne by the second spindle.

The embodiment shown in FIG. 5 differs from the embodiment shown in FIG. 4 in that there is no bar, the housing does not have slots and other features for receiving the bar, and the second spindle is different. The second spindle 13' has a pivotable retaining element 44 that extends from the end of the spindle in a direction substantially perpendicular to the axis of the spindle when the spindle bears the stub roll in order to discourage pilferage of the roll. To permit access to the stub roll, the retaining element 44 is pivoted so that it extends beyond the end of the spindle, as shown in FIG. 6.

Figure 8:
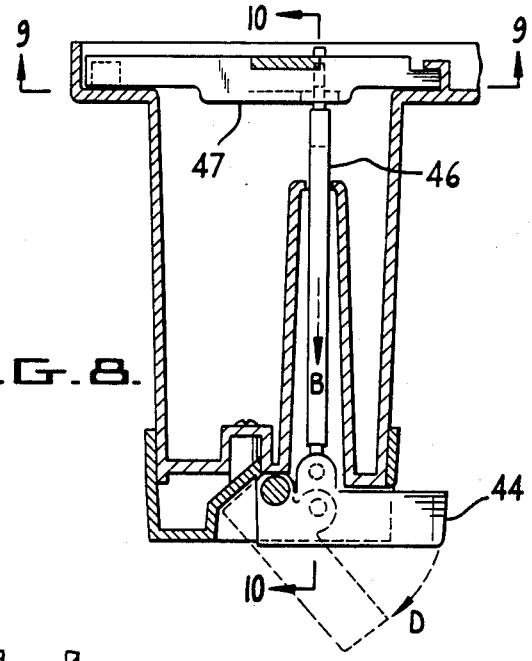
FIG. 8 is a sectional view of the second spindle taken along line 8—8 in FIG. 5.
Figure 9:
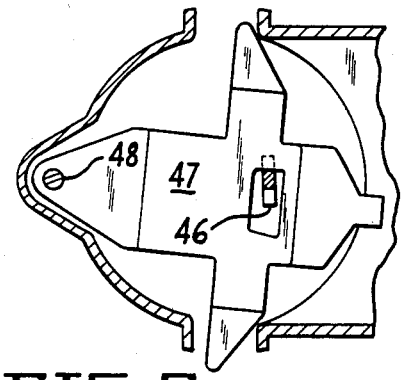
FIGS. 9 and 11 are sectional views of the second spindle taken along line 9—9 in FIG. 8.
Figure 10:
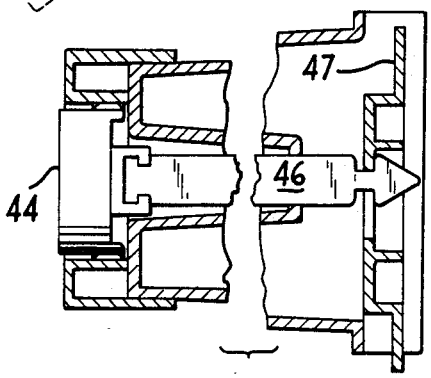
FIGS. 10 and 12 are sectional views of the second spindle taken along line 10—10 in FIG. 8.
Figure 11:
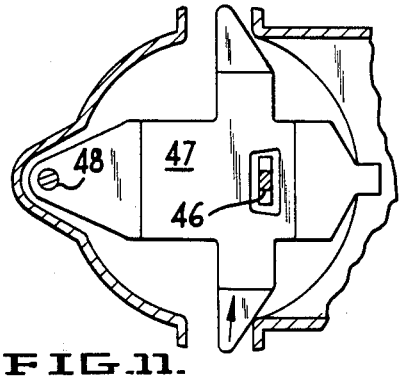
Figure 12:
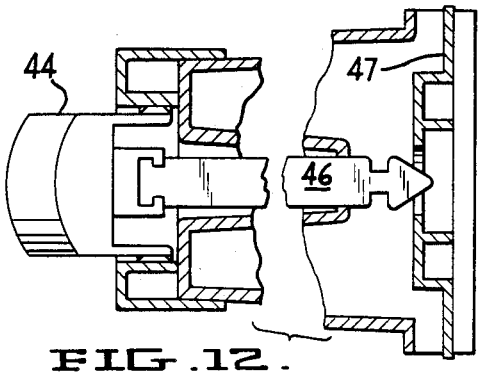

As best seen in FIGS. 8, 10 and 12, the retaining element 44 is connected to a latch 46 that extends though the interior of the second spindle 13'. As shown in FIGS. 9 and 10, the latch 46 engages a latch plate 47 when the retaining element 44 extends beyond the circumference of the spindle to secure the stub roll borne by the spindle. The latch plate 47 has an aperture 48 by which the latch plate is mounted to the base of the spindle for pivotal movement (as shown by arrow A in FIG. 7). The latch plate 47 is normally out of view (hidden from potential pilferers) but is accessible to an attendant by a recess at the base of the spindle. When the stub roll is depleted, the attendant pushes up on the lower end of the latch plate 47 (as shown by the arrow in FIG. 11) to release the latch 46. The released latch 46 retracts (as shown by arrow B in FIG. 8) as the attendant pivots the retaining element 44, as shown by arrow C in FIG. 7 and arrow D in FIG. 8. This enables the attendant to remove the depleted stub roll and replace it with a new stub roll removed at the same time from the first spindle. When the new stub roll has been placed on the second spindle, the attendant pivots the retaining element 44 back into the position where it secures the roll as the latch 46 engages the latch plate 47. Because the second spindle 13'' is inverted when it is mounted on the other side of the dispenser, the latch plate 47 is adapted to engage the latch 46 in the inverted position as well. For example, the end of the latch 46 that engages the latch plate 47 preferably has the profile of an arrow head. Another movable retaining element, such as a push button, may be substituted for the pivotable retaining element 44. Similarly, means other than a latch may be employed for locking the retaining element in the extended position and for releasing the retaining element from the locked position.

We claim:

1. A roll of toilet tissue having a diameter between about 20 and 30 centimeters, the roll having an initial section corresponding to a roll diameter of between about 40 and 60 percent of the diameter of the roll and a remaining terminal section, the initial section being the section closest to the core and having transverse lines of perforations, and the terminal section being unperforated.

* * * * *